US005974921A

United States Patent [19]

Ichikawa et al.

[11] Patent Number: 5,974,921

[45] Date of Patent: Nov. 2, 1999

[54] CONTACT PRESSURE CONTROL METHOD AND DEVICE FOR ROTARY CUTTER

[75] Inventors: Shigeru Ichikawa, Fujinomiya; Yoshiharu Okahashi, Takaishi, both of Japan

[73] Assignees: Maysun Co., Ltd., Shizuoka; Asahi Machinery Ltd, Osaka, both of Japan

[21] Appl. No.: 08/963,909

[22] Filed: Nov. 4, 1997

[30] Foreign Application Priority Data

Nov. 6, 1996 [JP] Japan ..... 8-293560

[51] Int. Cl.[6] ..... B26D 1/62

[52] U.S. Cl. ..... 83/13; 83/75; 83/76.1

[58] Field of Search ..... 83/13, 37, 72, 83/74, 76.1, 170, 288, 363, 361, 373, 546, 522.15, 522.21, 76.6, 76.7, 76.9, 75; 435/290

[56] References Cited

U.S. PATENT DOCUMENTS

| | | | |
|---|---|---|---|
| 3,745,864 | 7/1973 | Watson | 83/363 |
| 4,343,209 | 8/1982 | Moelbert | 83/170 |
| 4,426,897 | 1/1984 | Littleton | 83/37 |
| 4,594,923 | 6/1986 | Fujita | 83/363 |
| 4,653,361 | 3/1987 | Zobeli | 83/74 |
| 4,719,830 | 1/1988 | Kawada et al. | 83/74 |
| 4,768,433 | 9/1988 | Boissevain . | |
| 4,781,090 | 11/1988 | Feldkamper et al. | 83/74 |
| 4,872,381 | 10/1989 | Storms | 83/76.1 |
| 4,955,265 | 9/1990 | Nakagawa et al. | 83/74 |
| 5,061,630 | 10/1991 | Knopf et al. | 435/290 |
| 5,125,250 | 6/1992 | Sun | 83/288 |

FOREIGN PATENT DOCUMENTS

| | | |
|---|---|---|
| 0069976 | 1/1983 | European Pat. Off. . |
| 61-4614 | 1/1986 | Japan . |
| 3-149116 | 6/1991 | Japan . |
| 2266487 | 11/1993 | United Kingdom . |
| 93/19904 | 10/1993 | WIPO . |

*Primary Examiner*—Rinaldi I. Rada
*Assistant Examiner*—Gyounghyun Bae
*Attorney, Agent, or Firm*—Evenson, McKeown, Edwards & Lenahan, PLLC

[57] ABSTRACT

In a rotary cutter, a contact pressure profile can be adjusted by judging or detecting a contact pressure profile of a knife in its longitudinal direction and heating or cooling respective portions of the knife or plain rotor according to the judged or detected contact pressure profile.

20 Claims, 11 Drawing Sheets

CONTACT PRESSURE CONTROL METHOD AND DEVICE FOR ROTARY CUTTER

BACKGROUND OF THE INVENTION

1. Field of the Invention

The present invention relates to a rotary cutter for cutting consecutively such sheet material as paper strip, paper board, synthetic resin film, etc. into pieces with desired length, in particular, to a contact pressure control method for this kind of rotary cutter and a device therefor.

2. Description of the Prior Art

The sheet product such as paper, film, etc., includes a group of flat product and another group of roll product. The flat product is formed by cutting the product supplied from a sheet manufacturing line or the roll product in the feeding direction and the width direction of the product with a slitter and a fly knife in a cutter or a sheeter.

Regarding the cutting method, a slitter employing the type of thin upper and lower blades produces little paper dust even in cutting the paper of 600 g/m2. But there are some problems in cutting with a fly knife. In the type with one fixed blade shown in FIG. 12 of attached drawings, for example, a paper sheet 1 is cut by a fixed blade 2 and a rotating blade 3, but this type has not enough power for cutting a thick paper. To cut the thick paper, a twin rotor type with upper and lower rotating blades 4 and 5 shown in FIG. 13 has been developed and is in main use at present. In this twin rotor type, however, an adjusting operation for matching relative positions of the upper and the lower rotating blades is so difficult that even a skilled worker needs six to eight hours for the blade position matching in some cases.

To solve these problems, a rotary cutter with a structure shown in FIG. 14 has been developed. The details of the structure and the operation of this rotary cutter are disclosed in the Japanese Patent Laid-Open Publication Number 6-304895/1994. Briefly described, the rotary cutter comprises a knife rotor 6, a plain rotor 7, and a feed roller 8. The knife rotor 6 has knives 9*a*, 9*b* which are mounted on the two portions of outer surface of said knife rotor and arranged in the longitudinal direction of the knife rotor. In this rotary cutter, the paper sheet 1 which is sandwiched between and fed from the plain rotor 7 driven by a variable speed motor and the feed roller 8 is cut by the knife 9*a* attached to the outer surface of the knife rotor 6 driven by a servo motor while the paper 1 is pressed against the plain rotor 7. The knife rotor 6 is controlled and driven so as to rotate at the same speed with that of the fed paper 1 only when the attached knives 9*a*, 9*b* contact the paper 1 to be cut.

The structure and operation of this rotary cutter have been described above and a holding mechanism of the respective knives 9*a*, 9*b* in the knife rotor 6 is, for example, as shown in an enlarged partial sectional view of FIG. 15. As shown in FIG. 15, the knife 9*a* is attached to the knife rotor 6 as follows. At first, a knife holder 12 equipped with a permanent magnet 11 is fixed by a bolt 13 into a groove 10 formed in the longitudinal direction of the knife rotor 6, and then, into an insertion groove 14 formed consequently, the knife 9*a* is simply inserted, and, as a result, the knife can be fixed to the knife rotor 6 due to the magnetic effect. Accordingly, the knife replacement service can be carried out within a few seconds and the period for knife replacement has surprisingly been reduced.

But in such material as film where a cut section is expected to be a similar one cut by a guillotine, even a rotary cutter as described above needs the blade position matching, that is, the clearance between the plain rotor 7 and the position of knife rotor 6 in FIG. 14 and FIG. 15 must be adjusted. Traditionally, the clearance is adjusted in a manner that the relative position of the upper and lower blades is adjusted by carefully examining the cut section of a sheet or carefully listening to the sound at the cutting, and therefore, the adjusting operation is still a difficult work.

Furthermore, the contact pressure, even if once adjusted, changes in the long hour running due to the knife wear itself or to the variation in size resulting from the expansion and contraction of the knife and surrounding machine components. It is very difficult to compensate these factors.

The object of the present invention is to provide a contact pressure control method and a device for a rotary cutter which solves the problems of the conventional technology as described above.

SUMMARY OF THE INVENTION

According to one aspect of the present invention, there is provided a contact pressure control method for controlling a contact pressure of a knife mounted on a knife rotor against a plain rotor, said contact pressure control method being applied to a rotary cutter for cutting a sheet material consecutively into pieces with predetermined length, said rotary cutter comprising:

said knife rotor equipped with at least one knife on its outer surface in the longitudinal direction of said knife rotor; and said plain rotor disposed parallel to said knife rotor so as for the outer surface of said plain rotor to almost come in contact with the blade edge of said knife on said knife rotor, characterized in that said method comprises the steps of judging a contact pressure profile of said knife in its longitudinal direction, and adjusting said contact pressure profile according to the judged contact pressure profile by heating or cooling respective portions of said knife or said plain rotor.

According to one embodiment of the present invention, the judgment of said contact pressure profile is executed by visually examining the cut section of the sheet material.

According to another embodiment of the present invention, the judgment of said contact pressure profile is executed according to the respective contact pressure values detected by a plurality of contact pressure sensors arranged along said knife in its longitudinal direction.

According to a second aspect of the present invention, there is provided a contact pressure control method for controlling a contact pressure of a knife mounted on a knife rotor against a plain rotor, said contact pressure control method being applied to a rotary cutter for cutting a sheet material consecutively into pieces with predetermined length, said rotary cutter comprising:

said knife rotor equipped with at least one knife on its outer surface in the longitudinal direction of said knife rotor; and said plain rotor disposed parallel to said knife rotor so as for the outer surface of said plain rotor to almost come in contact with the blade edge of said knife, characterized in that said device comprises:

a contact pressure profile detection means arranged in the longitudinal direction of said knife for generating contact pressure signals indicating the contact pressure values at the respective portions of said knife; and an adjusting means arranged in said longitudinal direction of said knife or said plain rotor for adjusting a contact pressure profile of said knife to a desired profile according to said contact pressure signals from said contact pressure profile detection means by heating or cooling respective portions of said knife or said plain rotor.

According to one embodiment of the present invention, the contact pressure detection means comprises a plurality of piezoelectric elements arranged at the respective bottom portions of said knife for outputting the contact pressure signals indicating the respective contact pressures thereof and said adjusting means comprises a plurality of temperature control elements for heating or cooling the respective portions of said knife.

According to another embodiment of the present invention, an input/output control means for controlling an input/output of the signals and a power supply to said plurality of piezoelectric elements and said plurality of temperature control elements is disposed inside said knife rotor, an operation control means for said contact pressure control device is disposed outside said knife rotor, and said input/output control means and said operation control means are electrically connected through a rotary connector having a rotatable portion moving together with said knife rotor.

According to another embodiment of the present invention, the input/output control means and said operation control means are connected with each other through a serial communication line.

According to another embodiment of the present invention, the temperature control means are heater elements or Peltier elements or induction heating coils.

According to a third aspect of the present invention, there is provided a contact pressure control device for controlling a contact pressure of a knife mounted on a knife rotor against a plain rotor, said contact pressure control device being installed in a cutting a sheet material consecutively into pieces with predetermined length, said rotary cutter comprising:

said knife rotor equipped with at least one knife on its outer surface in the longitudinal direction of said knife rotor; and said plain rotor disposed parallel to said knife rotor so as for the outer surface of said plain rotor to almost come in contact with the blade edge of said knife, characterized in that said contact pressure control device comprises:

an adjusting means arranged in said longitudinal direction of said knife or said plain rotor for adjusting a contact pressure profile of said knife to a desired profile by heating or cooling respective portions of said knife or said plain rotor; and an operation control means for inputting said heating or cooling commands according to the contact pressure profile in said longitudinal direction of said knife.

According to one embodiment of the present invention, the adjusting means comprises a plurality of temperature control elements for heating or cooling the respective portions of said knife.

According to another embodiment of the present invention, an input/output control means for controlling an input/output of the signals to said plurality of temperature control elements and power supply is disposed inside said knife rotor and said input/output control means and said operation control means are electrically connected through a rotary connector having a rotatable portion moving together with said knife rotor.

According to another embodiment of the present invention, the input/output control means and said operation control means are connected with each other through a serial communication line.

According to another embodiment of the present invention, the adjusting means comprises a temperature control element for heating or cooling the respective portions of said plain rotor.

According to another embodiment of the present invention, the temperature control element comprises a plurality of elements arranged in the longitudinal direction of said plain rotor.

According to another embodiment of the present invention, the temperature control element comprises at least one element which is moved in the longitudinal direction of said plain rotor and set to a desired position.

According to another embodiment of the present invention, the temperature control element is a heater element or an induction heating coil or a cooling air supply element.

BRIEF DESCRIPTION OF THE DRAWINGS

The present invention and its preferred embodiments will be described in greater detail with reference to the accompanying drawings, in which.

DESCRIPTION OF THE PREFERRED EMBODIMENTS

Figure 1:
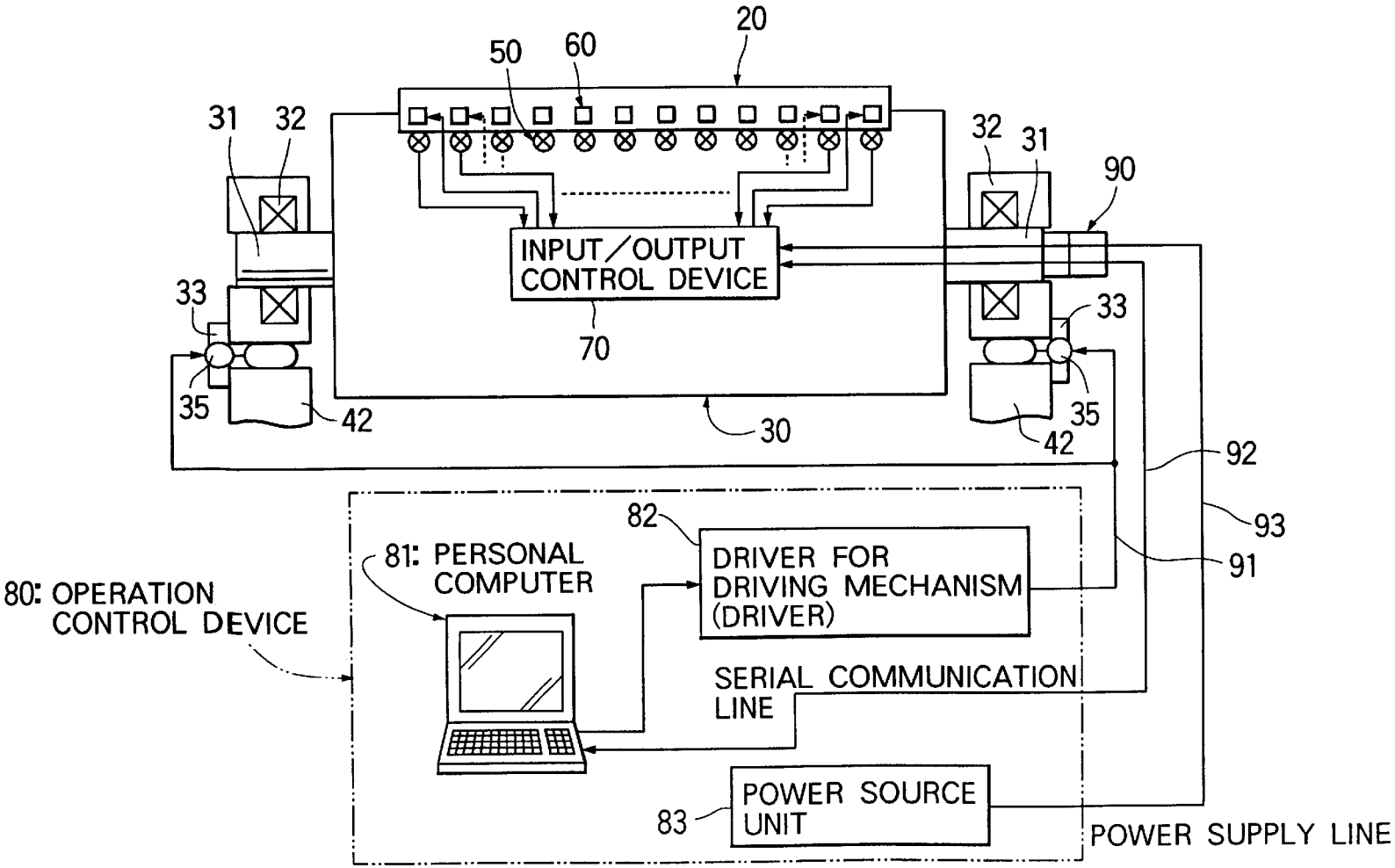
FIG. 1 is a schematic diagram illustrating the overall system of a rotary cutter incorporating a contact pressure control device of an embodiment of the present invention.

FIG. 1 is a schematic diagram illustrating the overall system of a rotary cutter incorporating a contact pressure control device of an embodiment of the present invention. The rotary cutter of this embodiment, as shown in FIG. 1, comprises a knife rotor 30 with at least one knife 20 which is mounted on the outer surface of said knife rotor 30 in the longitudinal direction thereof and a plain rotor (not illustrated) which is disposed parallel to said knife rotor 30 so as for the outer surface of said plain rotor to almost come in contact with a blade edge of the knife 20. A rotary shaft 31 of the knife rotor 30 is rotatably supported with both end portions held by a pair of bearing boxes 32 respectively. The bearing box 32 is connected to a bearing box 42 of the plain rotor through a toggle mechanism 33. The toggle mechanism 33 is actuated by an actuator 35 so that the contact pressure of the knife 20 against the plain rotor can be adjusted by controlling the positions of the both end portions of the rotary shaft 31 relative to the both end portions of the rotary shaft of the plain rotor.

In this embodiment, a contact pressure control device of an embodiment of the present invention comprises a contact pressure profile detection means 50 which is arranged in the longitudinal direction of the knife 20 for generating contact pressure signals indicating the contact pressure values at the respective portions of the knife 20 and an adjusting means 60 which is arranged in the longitudinal direction of the knife 20 for adjusting the contact pressure profile of the knife 20 to a desired contact pressure profile according to the contact pressure signals from the contact pressure profile detection means 50 by heating or cooling the respective portions of the knife 20. Furthermore, the contact pressure control device of this embodiment comprises: an input/output control device 70 arranged inside the knife rotor 30 for controlling an input/output signal and a power supply for the contact pressure profile detection means 50 and the adjusting means 60; and an operation control device 80 arranged outside the knife rotor 30 for inputting the heating or cooling command into the adjusting means 60 through the input/output control device 70 based on the contact pressure profile detected in the longitudinal direction of the knife 20 and through the input/output control device 70. The input/output control device 70 and the operation control device 80 are electrically connected with each other through a rotary connector 90 which is attached to the rotary shaft 31 of the knife rotor 30 and has a rotatable portion moving together with the rotary shaft 31.

In this embodiment, the operation control device 80 comprises a control means 81 composed of a personal computer etc., a driver for a driving mechanism 82 (hereafter referred to as driver) to drive an actuator 35, and a power source unit 83. The driver 82 which is controlled by the control means 81 controls an operation of the actuator 35 through a line 91. The control means 81 is constituted so as to give a control command and the like to the input/output control device 70 through a serial communication line 92. The power source unit 83 supplies the input/output control device 70 with an electric power through a power supply line 93. No detailed description will be made on the structure and operation of the rotary connector 90 because various kinds of rotary connectors have already been developed and sold in the market for power supply and signal input/output of rotating parts or other uses.

Figure 2:
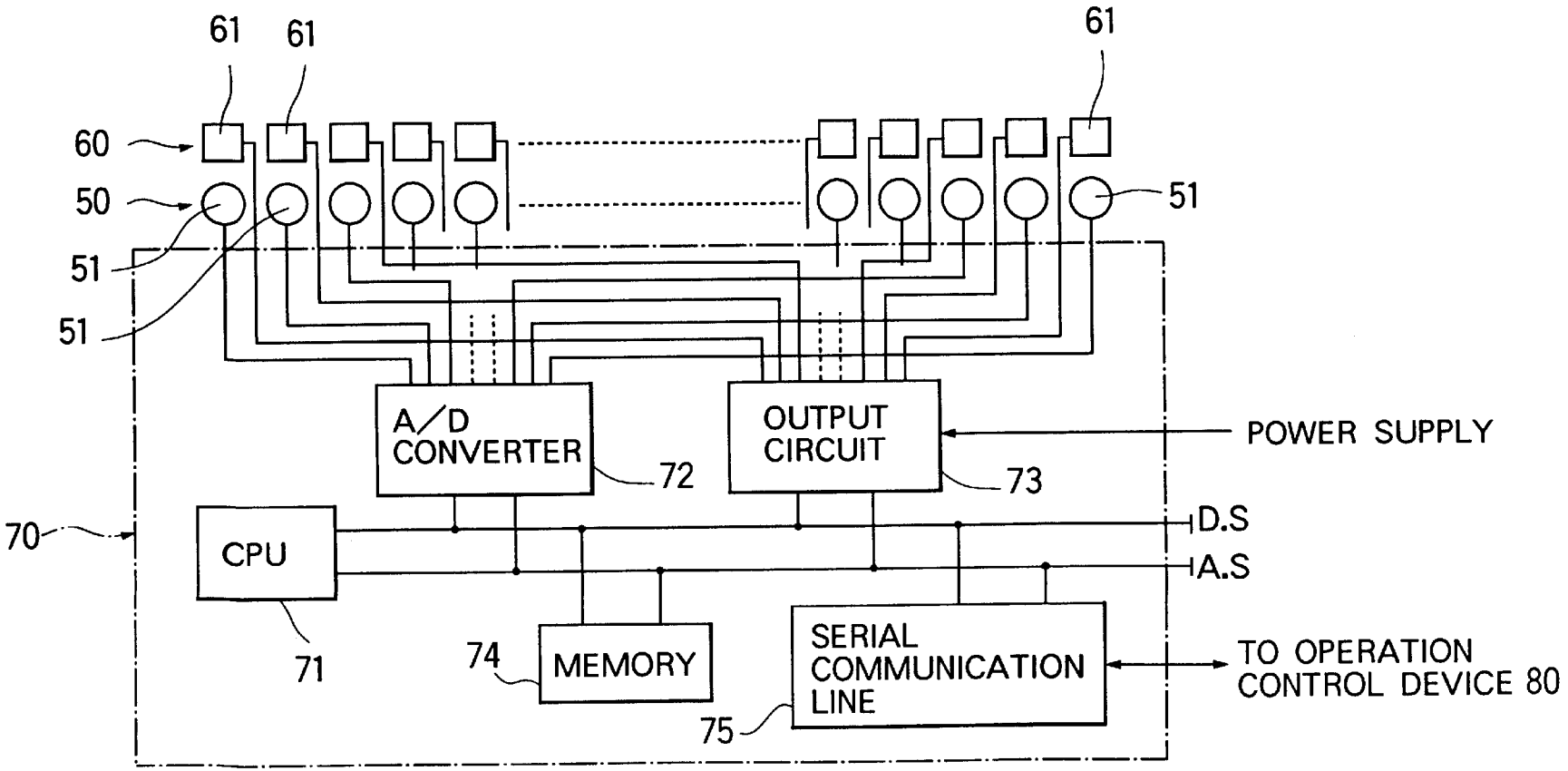
FIG. 2 is a block diagram showing in further detail connecting circuits between the contact pressure profile detection means and the adjusting means of the contact pressure control device in FIG. 1 and the input/output control device disposed within the knife rotor.

FIG. 2 is a block diagram of detailed circuits illustrating how the contact pressure profile detection means 50 and the adjusting means 60 are electrically connected with the input/output control device 70 disposed inside the knife rotor 30. The circuit and operation related to this input/output control device 70 will be described later.

Now will be described in detail a detecting method for contact pressure in a contact pressure control of the present invention. As clearly shown in FIG. 3 of a schematic plan view of the knife rotor 30, the knife rotor 30 is equipped with a knife holder 36 to fix the knife 20 and a plurality of piezoelectric elements 51 of contact pressure sensors are arranged along the bottom line of the knife holder 36. The signal from each piezoelectric element 51 representing the local contact pressure is inputted through the rotary connector 90 into a contact pressure distribution display means 100, for example, an oscilloscope.

Figure 4:
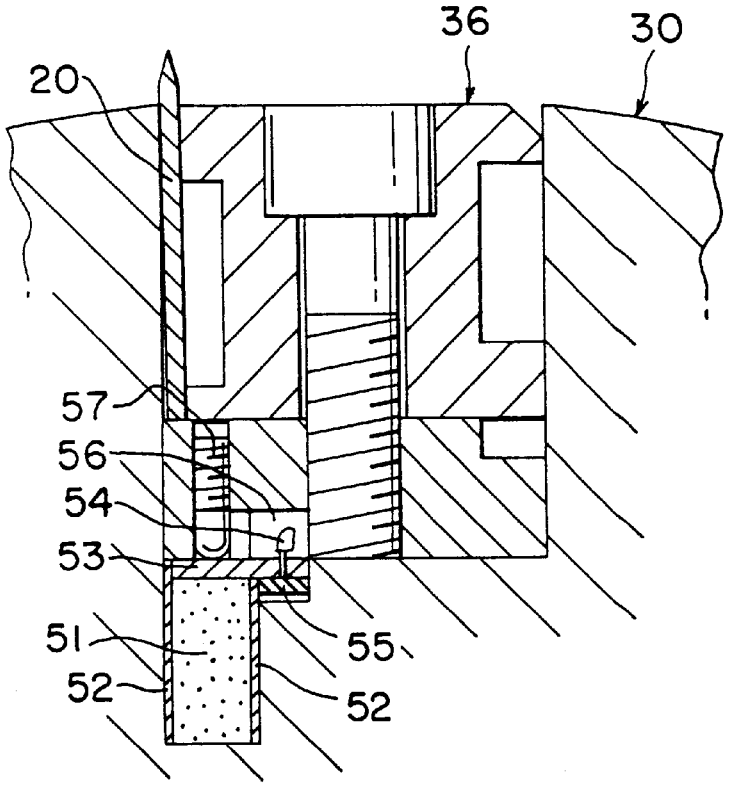
FIG. 4 is an enlarged partial sectional view of piezoelectric elements disposed in the knife rotor of FIG. 3.

Usually, the local contact pressure of the knife 20 against the plain rotor subtly varies from position to position along the knife 20 in its longitudinal direction. Therefore, as shown in the enlarged partial sectional view of FIG. 4, a plurality of piezoelectric elements 51 are embedded at the bottom of the knife holder 36 installed in the knife rotor 30. Many piezoelectric elements 51 are disposed along the knife 20 in its longitudinal direction so that the contact pressure distribution along the knife 20 in its longitudinal direction can be measured. As clearly shown in FIG. 4, each piezoelectric element 51 is embedded in a location hole formed at the bottom of the knife holder 36 with an insulator 52 placed between the piezoelectric element 51 and the inner surface of said location hole and is mounted on a printed circuit board 53. In addition, a thrust pressure adjusting screw 57 is connected to each piezoelectric element 51. To the printed circuit board 53 is connected an electrode 54 to the piezoelectric element 51, and the electrode 54 is electrically connected to the input/output control device 70 arranged inside the knife rotor 30 by a lead wire passing through a wire space 56 therefor. The conductive materials connected to the printed circuit board 53 are insulated by an insulator 55.

Figure 3:
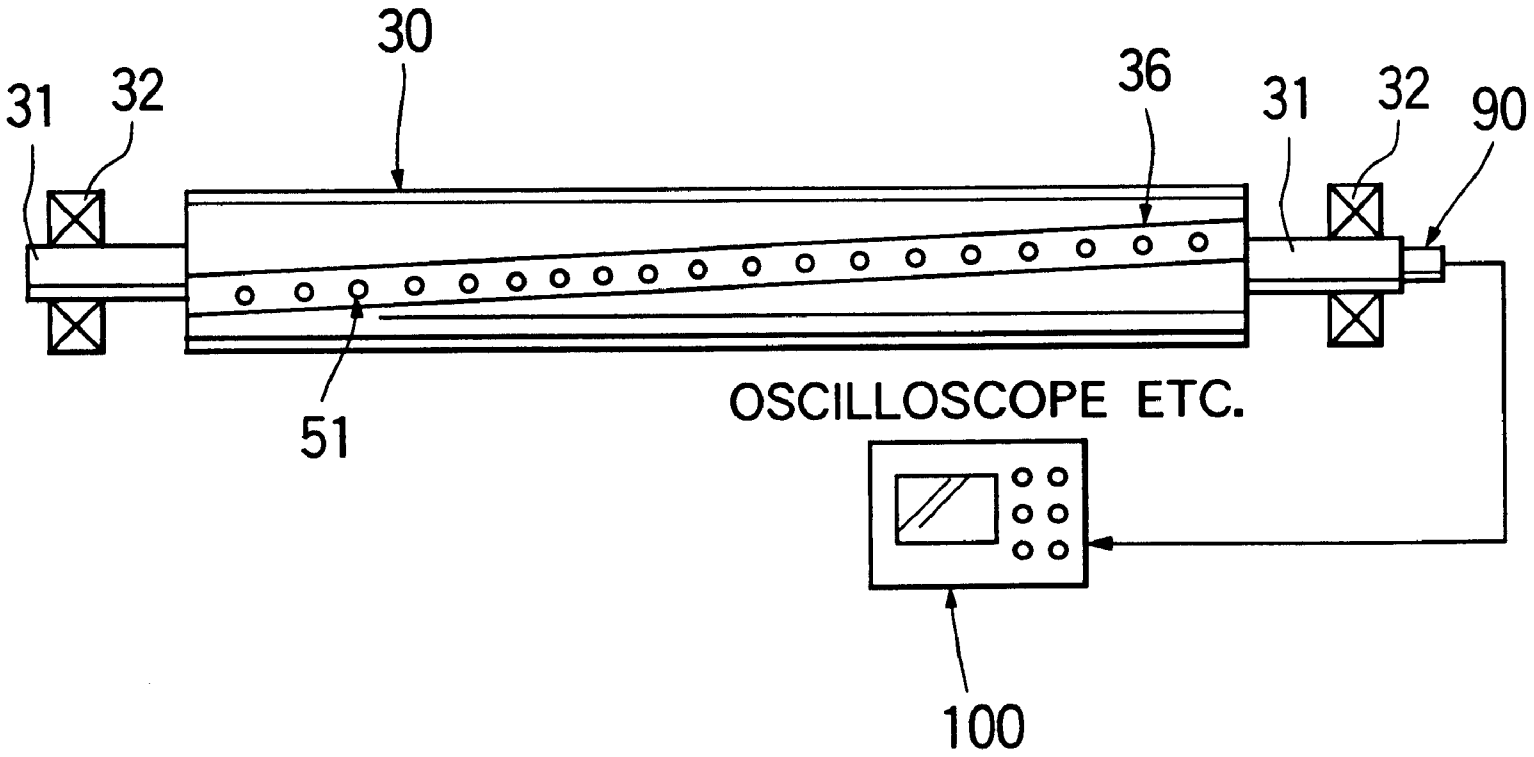
FIG. 3 is a schematic plan view showing only the knife rotor of the rotary cutter of FIG. 1.

Conveniently, for measuring the contact pressure distribution along the knife 20 in its longitudinal direction, the knife holder 36 is attached obliquely to the knife rotor 30, as clearly shown in FIG. 3. Accordingly, the contact pressure distribution can be visualized for a simplified observation by connecting in parallel the outputs from the respective piezoelectric elements 51, taking out the outputs through the rotary connector 90 and the like, and displaying them on an oscilloscope 100 and others. Besides a piezoelectric element, any sensor may serve as a contact pressure sensor like this so long as it can convert pressure into electric signal.

Figure 5:
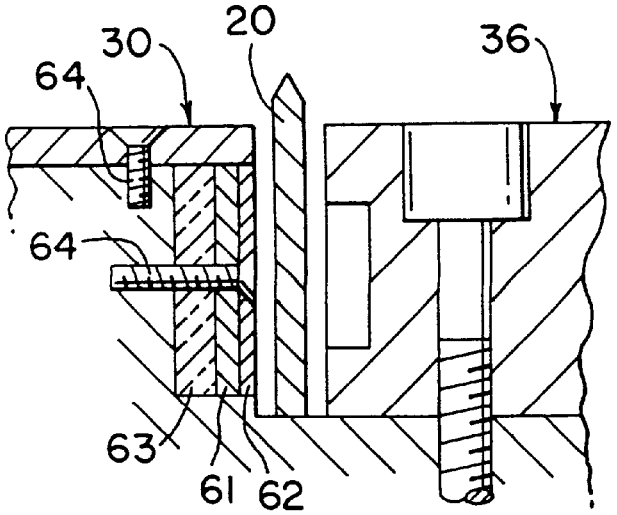
FIG. 5 is an enlarged partial sectional view of the heating means comprising a plane heater for controlling respective contact pressures on the knife of the rotary cutter of FIG. 1.

It will now be described in detail how the contact pressure is adjusted in the contact pressure control of the present invention. FIG. 5 is an enlarged partial sectional view of an embodiment showing how the respective contact pressures on the knife 20 are controlled by heating according to the contact pressures detected by the respective contact pressure sensors 50 shown in FIGS. 1 and 2. As a heating means in this embodiment, a heater with plane surface (hereafter referred to as a plane heater) is employed. The plane heater 61, as shown in FIG. 5, is placed between a retaining plate 62 and an insulation material 63 and is fixed with a flat countersunk head screw 64 onto the inside wall of knife rotor 30 facing to the side of the knife 20 held by the knife holder 36. The heating means which employs a plane heater like this has an advantage of being simple and inexpensive, but an air gap, if it exists, may lower the thermal efficiency.

Figure 6:
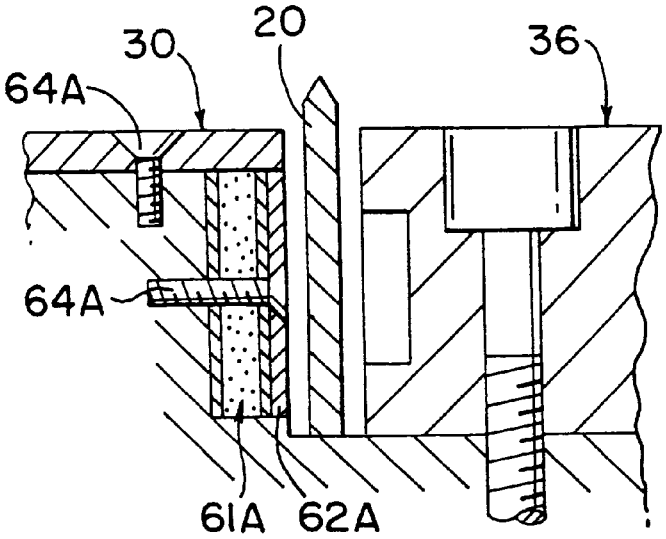
FIG. 6 is an enlarged partial sectional view of the adjusting means comprising Peltier elements for controlling respective contact pressures on the knife of the rotary cutter of FIG. 1.

FIG. 6 is, besides FIG. 5, an enlarged partial sectional view of another embodiment of the adjusting means. This adjusting means employs a Peltier element to adjust the contact pressure by heating or cooling the respective portions of the knife 20. The Peltier element 61A, as shown in FIG. 6, is fixed with a flat countersunk head screw 64A and a retaining plate 62A onto the inside wall of the knife rotor 30 facing the side of the knife 20 held by the knife holder 36. The Peltier element 61A is a kind of semiconductor which can be easily heated or cooled by only switching the direction of the current passing through the element. The adjusting means which employs the Peltier element has an advantage of allowing easy switching of heating and cooling, but the means is somewhat expensive and has some potential problems in its strength and an air gap, if it exists, may lower the thermal efficiency.

Figure 7:
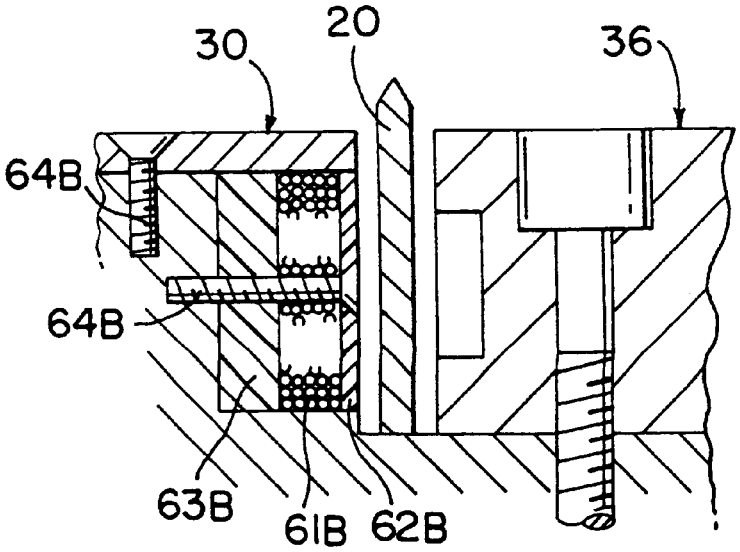
FIG. 7 is an enlarged partial sectional view of the adjusting means comprising induction heating coils for controlling respective contact pressures on the knife of the rotary cutter of FIG. 1.

FIG. 7 is, besides FIG. 5, an enlarged partial sectional view of another different embodiment of the adjusting means. This adjusting means employs an induction heating coil which allows the contact pressure to be adjusted by heating the respective portions of the knife 20 because the knife 20 is usually made of such material in which electromagnetic induction loss takes place. The induction heating coil 61B, as shown in FIG. 7, is placed between a retaining plate 62B made of plastic, nonferrous metal, etc. and a back plate 63B made of plastic, nonferrous metal, etc. and is fixed by a flat countersunk head screw 64B onto the inside wall of the knife rotor 30 facing to the side of the knife 20 held by the knife holder 36. The adjusting means which employs induction heating coil has an advantage of allowing only the knife to be heated even if an air gap exists, but the means becomes somewhat complex due to the necessity of incorporating a coil driver into the knife rotor 30.

Referring again to FIG. 1 and FIG. 2, there will now be described more details of the relationship among the piezoelectric elements 51 of a contact pressure sensor, the plane heater 61 of a contact pressure adjust, a means, and the input/output control device 70 disposed in the knife rotor 30. The input/output control device 70, as shown in FIG. 2, comprises as its main components, a CPU 71 as a central processing unit, an A/D converter 72, an output circuit 73, a memory 74, and a serial communication circuit 75. The output signals representing the contact pressures measured at the respective lower portions of the knife by a plurality of piezoelectric elements 51 arranged along the knife 20 in its longitudinal direction, are A/D-converted by the A/D converter 72, and then changed into a series of serial signals by the serial communication circuit 75, and transmitted to the operation control device 80 through the rotary connector 90 (see FIG. 1). The transmitted signals are taken into a personal computer 81, etc. to be displayed in a form of contact pressure profile on a CRT, etc.

Then the values of these contact pressure signals are compared with the desired values and the numerical data of the allowable range etc. inputted from a keyboard of the personal computer 81, etc. Based on the comparison results, it is judged which portions of the knife 20 in its longitudinal direction should be heated or cooled to make the respective contact pressure values at the respective portions of the knife fall within the allowable range of the target value. The operation control device 80 transmits the numerical data which has been multiplied by a predetermined coefficient, through the serial communication line 92 and the rotary connector 90, into the input/output control device 70 inside the knife rotor 30. Then based on these numerical data, the CPU 71 calculates the currents to be flowed into the respective plane heaters 61 and controls, through the output circuit 73, the heating condition of respective portions of the knife 20 by the respective plane heaters. Namely, into each plane heater 61 is flowed the current, which comes from the power source unit 83 of the operation control device 80 through the power supply line 93 and the rotary connector 90 and at the same time is controlled by the output circuit 73. An expected profile of contact pressure can be maintained by repeating operations mentioned above.

As it is known that the contact pressure profile along the knife 20 in its longitudinal direction can be adjusted by changing the local height of the knife 20, the plane heaters, the Peltier elements, the induction heating coils or the like, as previously described in various embodiments of the present invention, are embedded at the bottom of the knife 20 so that the local height of the knife can be changed by heating or cooling the knife 20 locally to cause the local expansion or contraction of the knife 20. Instead of changing the local height of the knife 20, local expansion or contraction of the plain rotor also allows the contact pressure profile to be controlled, and therefore the present invention also includes the adjusting method in this manner related to the plain rotor.

In the embodiments described above, the contact pressure is adjusted according to the detected contact pressure profile of the knife, but the present invention is not restricted to the details of this description. For example, the method which is dependent only upon the temperature control of the knife or the plain rotor can also be employed. Namely, in a control method of heating or cooling the knife or the plain rotor, the contact pressure can be adjusted by operating an operation device with a visual check of the section of the cut sheet instead of a measurement of contact pressure distribution.

Figure 8:
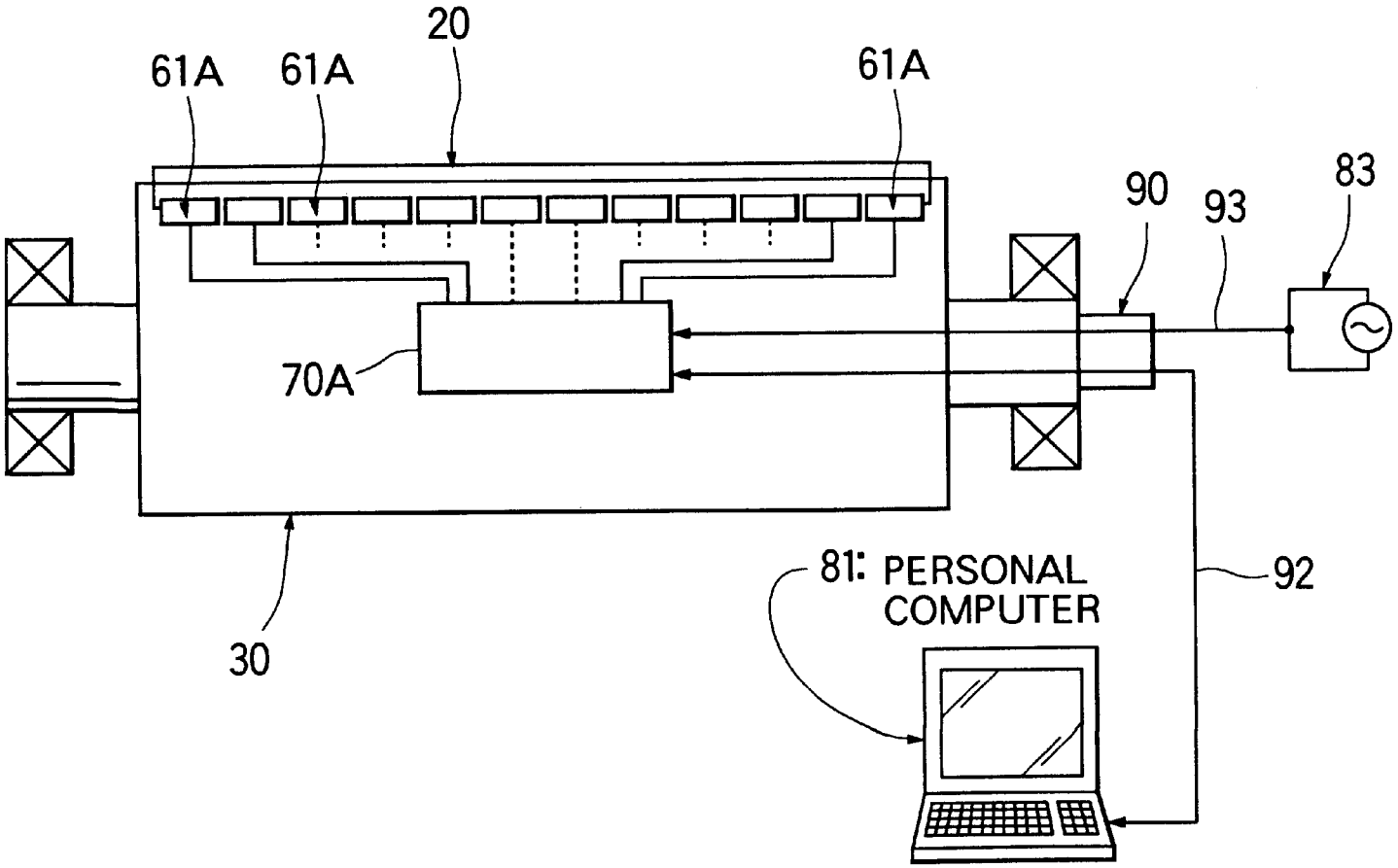
FIG. 8 is a schematic diagram showing a system for controlling contact pressure of a knife in a rotary cutter according to another embodiment of the present invention.

FIG. 8 is a schematic diagram of an embodiment in which the contact pressure is adjusted by heating or cooling the knife without measuring the contact pressure profile. In this embodiment, the Peltier elements 61A, described in the adjusting means of FIG. 6, are arranged along the knife 20 in its longitudinal direction. The personal computer 81 etc. placed outside the knife rotor 30 transmits the commands to the control device 70A arranged inside the knife rotor 30 through the serial communication line 92 and the rotary connector 90. In response to the commands, the control device 70A sets the respective currents for the respective Peltier elements 61A to the desired values by controlling the electric power supplied by the power source unit 83 through the power supply line 93 and the rotary connector 90. For example, after checking the improperly-cut section of the product, an operator can input the commands through the personal computer 81 etc. for controlling the currents to the Peltier elements at the areas of the knife which has caused the improperly-cut section. Though a Peltier elements is employed as an adjusting means in this embodiment, it goes without saying that a plane heater or an induction heating coil described above may also be employed.

Figure 9:
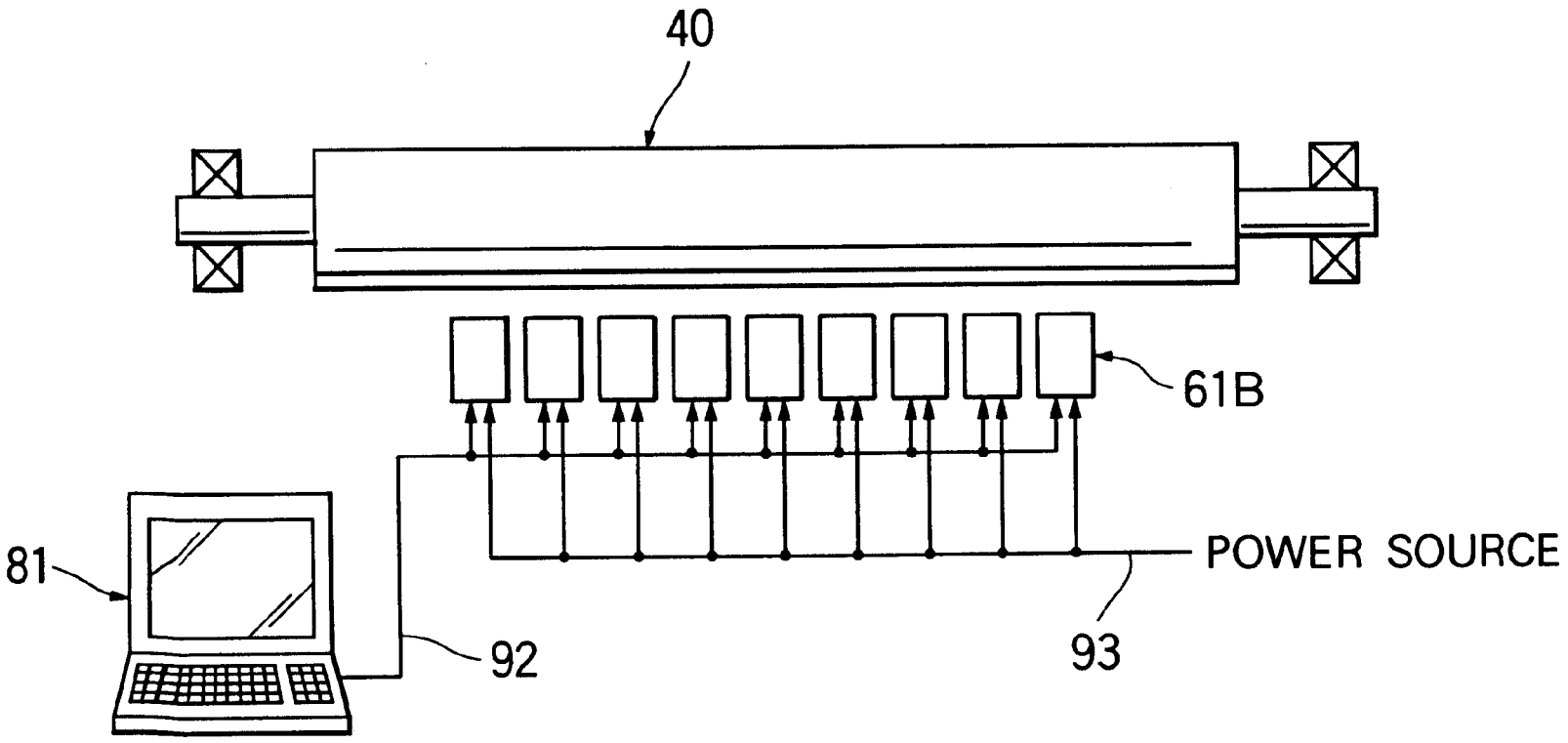
FIG. 9 is a schematic diagram showing a system for controlling contact pressure of a knife in a rotary cutter according to another embodiment of the present invention.

FIG. 9 is, besides FIG. 8, a schematic diagram of another embodiment in which the plain rotor 40, but not the knife 20, is heated or cooled. In this embodiment, a plurality of induction heating coils 61B are arranged along the plain rotor 40 in its longitudinal direction, and an operator, while visually checking the cut section of the product, may send the commands through the personal computer 81 etc. to adjust the contact pressure by controlling the electric power to be supplied by the power source through the power supply line to the induction heating coils 61B at the portions whose contact pressures should be adjusted. It is needless to say that the Peltier element or a plane heater may be employed instead of an induction heating coil.

Figure 10:
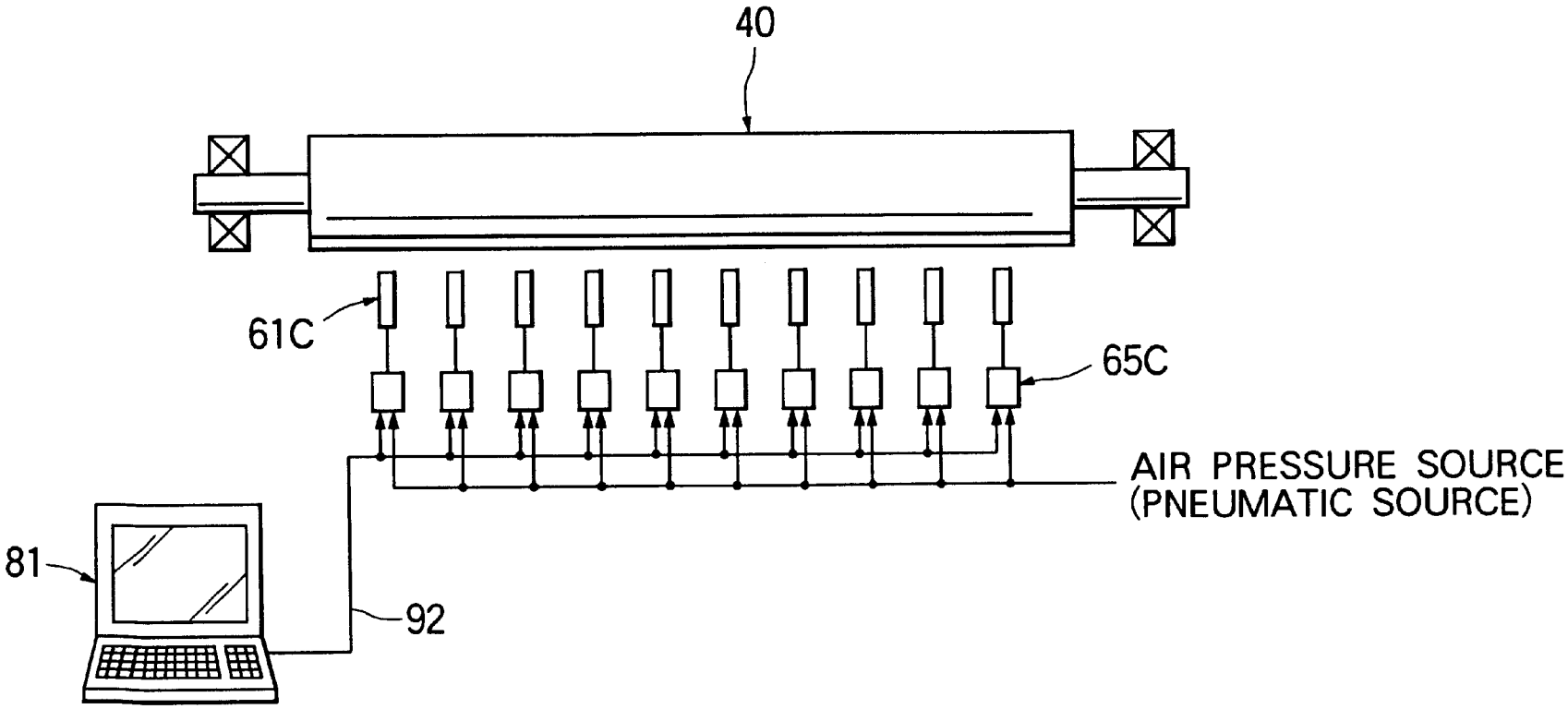
FIG. 10 is a schematic diagram showing a system for controlling contact pressure of a knife in a rotary cutter according to another embodiment of the present invention.

FIG. 10 is, besides FIG. 9, a schematic diagram of another different embodiment. In this embodiment, a plurality of cooling air suppliers 61C are arranged along the plain rotor 40 in its longitudinal direction to cool the respective portions thereof. The flow rate of the cooling air from each cooling air supplier 61C against the each portion of the plain rotor 40 is controlled by an electromagnetic valves 65C controlled by the control signals from the personal computer 81 and the like.

Figure 11:
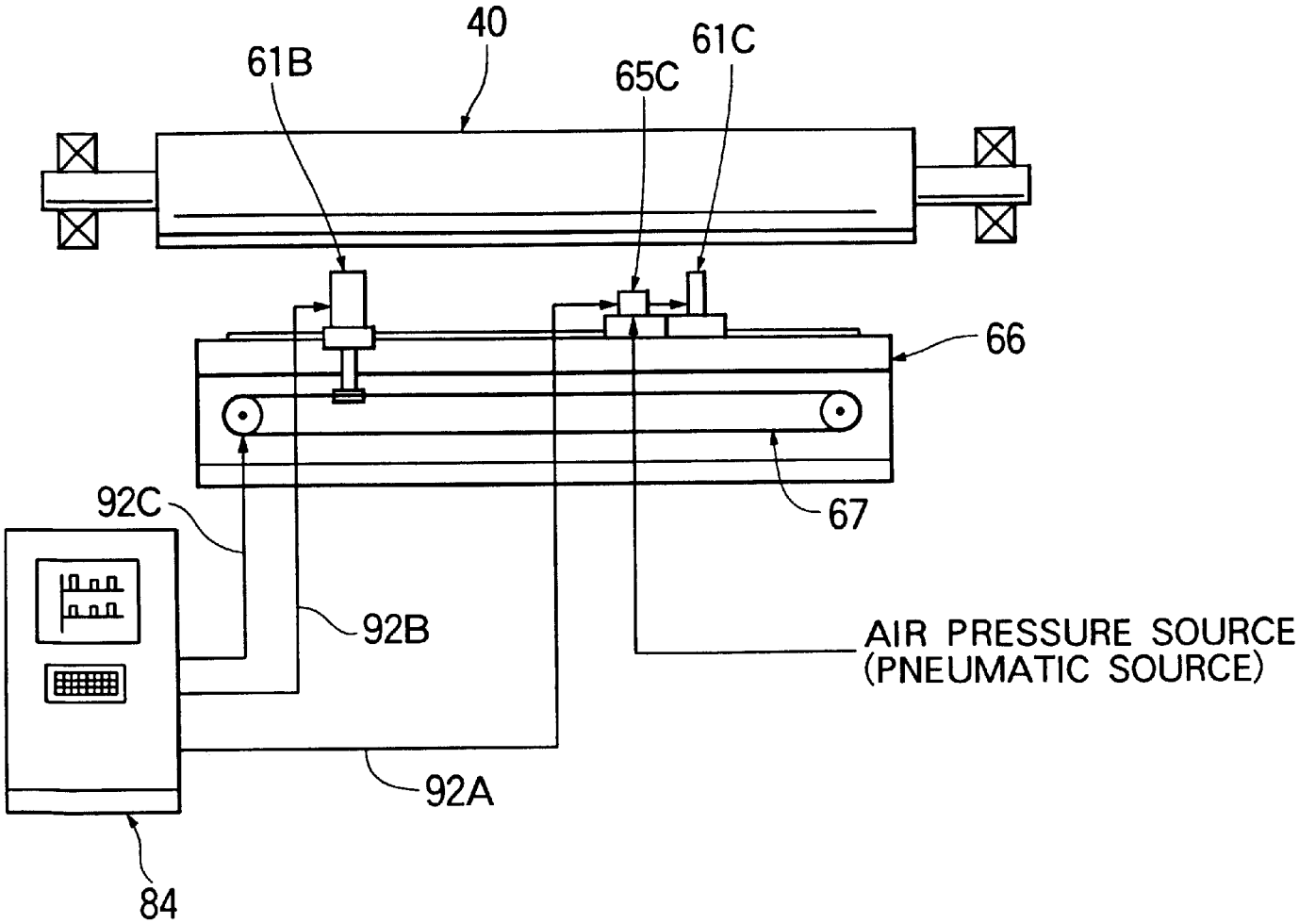
FIG. 11 is a schematic diagram showing a system for controlling contact pressure of a knife in a rotary cutter according to another embodiment of the present invention.
Figure 12:
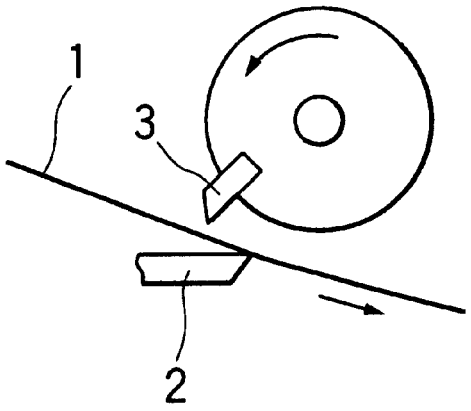
FIG. 12 PRIOR ART
FIG. 12 is a schematic diagram for use in explaining how a conventional rotary cutter with one fixed blade is operated.
Figure 13:
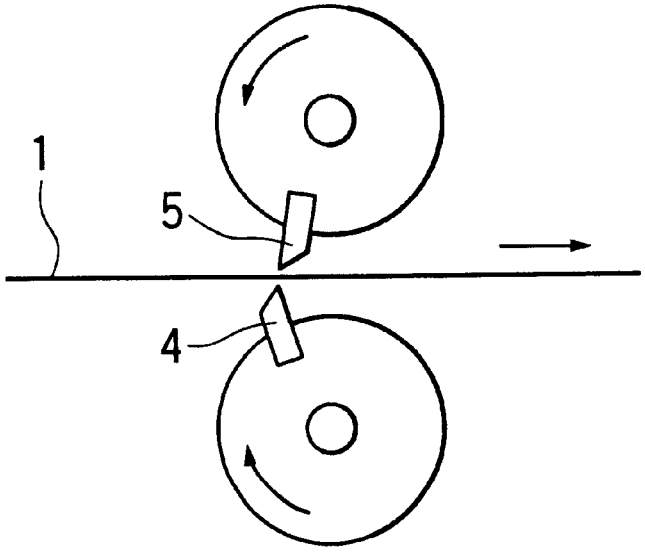
FIG. 13 PRIOR ART
FIG. 13 is a schematic diagram for use in explaining how a conventional twin rotor type rotary cutter is operated.
Figure 14:
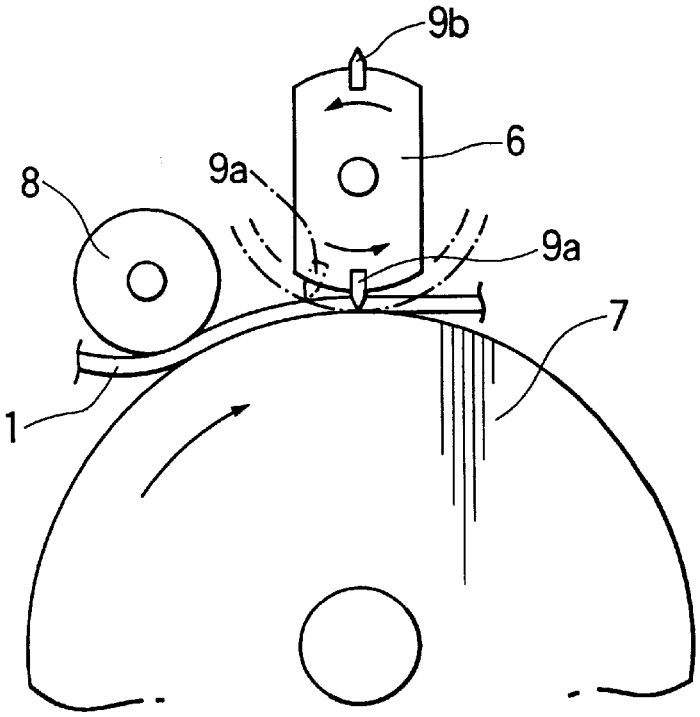
FIG. 14 PRIOR ART
FIG. 14 is a schematic diagram for use in explaining how a conventional rotary cutter with a knife rotor and a plain rotor is operated.
Figure 15:
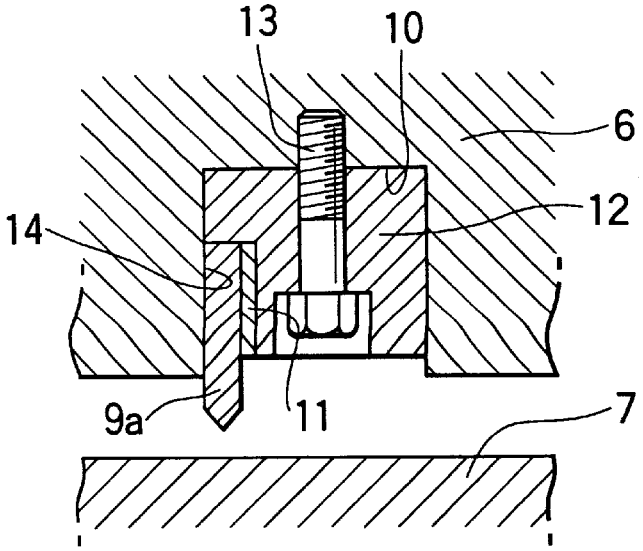
FIG. 15 PRIOR ART
FIG. 15 is a schematically sectional view of a structure for mounting a knife on the rotary cutter of FIG. 14.

FIG. 11 is, besides FIG. 10, a schematic diagram of another different embodiment. In this embodiment, a cooling air supplier 61C to cool the respective portions of the plain rotor 40 and an induction heating unit 61B to heat the respective portions of the plain rotor 40 are simultaneously employed. This embodiment employs one cooling air supplier 61C and one induction heating unit 61B which are movable along a slide base 66 extending along the plain rotor 40 in its longitudinal direction. The cooling air supplier 61C and the induction heating unit 61B are connected to a moving means 67 provided along the slide base 66, and are moved and set to the desired positions according to a positioning signal 92C from a control panel 84. The cooling air supplier 61C and the induction heating unit 61B are moved to the respective positions to cool or heat the corresponding portions of the plain rotor 40 according to an electromagnetic valve control signal 92A or an induction heating control signal 92B from the control panel 84.

The present invention allows a very easy and quick adjustment of the contact pressure for a rotary cutter knife. Also in the long hour running of the rotary cutter, the contact pressure changes caused by the knife wear itself or by the variation in size resulting from the expansion and contraction of the knife and surrounding machine components are compensated very easily and quickly.

As the present invention allows the contact pressure profile along a knife in its longitudinal direction, even an improperly-cut section etc. of a product caused by the middle part of the knife can immediately be corrected on the job spot.

What is claimed is:

1. A contact pressure control method for controlling a contact pressure of a knife mounted on a knife rotor against a plain rotor, said contact pressure control method being applied to a rotary cutter for cutting a sheet material consecutively into pieces with predetermined length, said rotary cutter including at least one knife on an outer surface of and extending in the longitudinal, direction of said knife rotor and having said plain rotor disposed parallel to said knife rotor so that the outer surface of said plain rotor almost comes in contact with the blade edge of said knife on said knife rotor, said method comprising the steps of:

judging a contact pressure profile of said knife in its longitudinal direction, and adjusting said contact pressure profile according to the judged contact pressure profile by heating or cooling respective portions of said knife or said plain rotor.

2. A contact pressure control method as claimed in claim 1, in which the judgment of said contact pressure profile is executed by visually examining the cut section of the sheet material.

3. A contact pressure control method as claimed in claim 1, in which the judgment of said contact pressure profile is executed according to the respective contact pressure values detected by a plurality of contact pressure sensors arranged along said knife in its longitudinal direction.

4. A contact pressure control device for controlling a contact pressure of a knife mounted on a knife rotor against a plain rotor, said contact pressure control device being applied to a rotary cutter for cutting a sheet material consecutively into pieces with predetermined length, said rotary cutter including at least one knife on an outer surface of and extending in the longitudinal direction of said knife rotor and having said plain rotor disposed parallel to said knife rotor so that the outer surface of said plain rotor almost comes in contact with the blade edge of said knife, said device comprising:

a contact pressure profile detection means arranged in the longitudinal direction of said knife for generating contact pressure signals indicating the contact pressure values at the respective portions of said knife; and an adjusting means arranged in said longitudinal direction of said knife or said plain rotor for adjusting a contact pressure profile of said knife to a desired profile according to said contact pressure signals from said contact pressure profile detection means by heating or cooling respective portions of said knife or said plain rotor.

5. A contact pressure control device as claimed in claim 4, in which said contact pressure detection means comprises a plurality of piezoelectric elements arranged at the respective bottom portions of said knife for outputting the contact pressure signals indicating the respective contact pressures thereof and said adjusting means comprises a plurality of temperature control elements for heating or cooling the respective portions of said knife.

6. A contact pressure control device as claimed in claim 5, in which an input/output control means for controlling an input/output of the signals and a power supply to said plurality of piezoelectric elements and said plurality of temperature control elements is disposed inside said knife rotor, an operation control means for said contact pressure control device is disposed outside said knife rotor, and said input/output control means and said operation control means are electrically connected through a rotary connector having a rotatable portion moving together with said knife rotor.

7. A contact pressure control device as claimed in claim 6, in which said input/output control means and said operation control means are connected with each other through a serial communication line.

8. A contact pressure control device as claimed claim 5, in which said temperature control elements are heater elements.

9. A contact pressure control device as claimed in claim 5, in which said temperature control elements are Peltrier elements.

10. A contact pressure control device as claimed of claim 5, in which said temperature control elements are induction heating coils.

11. A contact pressure control device for controlling a contact pressure of a knife mounted on a knife rotor against a plain rotor, said contact pressure control device being installed in a rotary cutter for cutting a sheet material consecutively into pieces with predetermined length, said rotary cutter including at least one knife on an outer surface of and extending in the longitudinal direction of said knife rotor and having said plain rotor disposed parallel to said knife rotor so that the outer surface of said plain rotor almost comes in contact with the blade edge of said knife, said contact pressure control device comprising:

an adjusting means arranged in said longitudinal direction of said knife or said plain rotor for adjusting a contact pressure profile of said knife to a desired profile by heating or cooling respective portions of said knife or said plain rotor; and an operation control means for inputting said heating or cooling commands according to the contact pressure profile in said longitudinal direction of said knife.

12. A contact pressure control device as claimed in claim 11, in which said adjusting means comprises a plurality of temperature control elements for heating or cooling the respective portions of said knife.

13. A contact pressure control device as claimed in claim 12, in which an input/output control means for controlling an input/output of the signals to said plurality of temperature control elements and power supply is disposed inside said knife rotor and said input/output control means and said operation control means are electrically connected through a rotary connector having a rotatable portion moving together with said knife rotor.

14. A contact pressure control device as claimed in claim 13, in which said input/output control means and said operation control means are connected with each other through a serial communication line.

15. A contact pressure control device as claimed in claim 11, in which said adjusting means comprises a temperature control element for heating or cooling the respective portions of said plain rotor.

16. A contact pressure control device as claimed in claim 15, in which said temperature control element comprises a plurality of elements arranged in the longitudinal direction of said plain rotor.

17. A contact pressure control device as claimed in claim 15, in which said temperature control element comprises at least one element which is moved in the longitudinal direction of said plain rotor and set to a desired position.

18. A contact pressure control device as claimed in claim 15, in which said temperature control element is a heater element.

19. A contact pressure control device as claimed in claim 15, in which said temperature control element is an induction heating coil.

20. A contact pressure control device as claimed in claim 15, in which said temperature control element is a cooling air supply element.

* * * * *